US005411373A

United States Patent [19]

Chiu et al.

[11] Patent Number: 5,411,373

[45] Date of Patent: May 2, 1995

[54] CONVERTIBLE FLOOR FAN

[75] Inventors: Bernard Chiu, Ashland, Mass.; Jui-Shang Wang, Taipei, Taiwan, Prov. of China

[73] Assignee: Duracraft Corporation, Whitinsville, Mass.

[21] Appl. No.: 72,374

[22] Filed: Jun. 7, 1993

[51] Int. Cl.[6] ..... F01D 5/00

[52] U.S. Cl. ..... 416/246; 248/676; 403/388

[58] Field of Search ..... 416/246; 248/676, 125; 403/380, 384, 388

[56] References Cited

U.S. PATENT DOCUMENTS

| | | | |
|---|---|---|---|
| 1,173,418 | 2/1916 | Ette | 403/388 |
| 1,782,660 | 11/1930 | Meyer | 403/104 |
| 2,000,386 | 5/1935 | Haynes | 416/246 |
| 2,164,608 | 7/1935 | Cornelius | 454/228 |
| 2,172,611 | 9/1939 | Gerhardt et al. | 403/388 |
| 2,364,794 | 12/1944 | Koch | 248/676 |
| 2,542,204 | 2/1951 | Moore | 248/676 |
| 2,578,397 | 12/1951 | Brown | 403/388 |
| 2,646,591 | 7/1953 | Knarzer | 403/384 |
| 3,464,655 | 9/1969 | Schuman | 248/125 |
| 5,295,811 | 3/1994 | Chiu | 415/208.2 |

FOREIGN PATENT DOCUMENTS

| | | | |
|---|---|---|---|
| 464554 | 4/1950 | Canada | 416/246 |
| 352051 | 9/1937 | Italy | 416/246 |
| 415541 | 8/1934 | United Kingdom | 403/388 |
| 599360 | 3/1948 | United Kingdom | 248/125 |
| 2077837 | 12/1981 | United Kingdom | 403/384 |

*Primary Examiner*—John T. Kwon

*Attorney, Agent, or Firm*—John E. Toupal; Harold G. Jarcho

[57] ABSTRACT

A portable electrical fan including a housing defining inlet and outlet openings for transmitting air; a fan blade disposed in the housing; a motor supported by the housing and rotatably coupled to the fan blade; a base for placement on a support surface and having a coupling for detachable connection to the housing, the base defining a base receiving portion; an elongated standard having one end detachably secured to the coupling and an opposite end detachably secured to the housing, the standard defining a standard receiving portion; an electrical control connected to the motor; an enclosure retaining the electrical control and removably receivable by either the base receiving portion or the standard receiving portion; and a retainer for securing the enclosure to either the base receiving portion or the standard receiving portion. Conversion of the invention into either a floor or table fan is easily accomplished.

19 Claims, 3 Drawing Sheets

CONVERTIBLE FLOOR FAN

BACKGROUND OF THE INVENTION

This invention relates generally to a portable electrical fan and, more particularly, to a portable fan that can be converted from a floor to a table type fan.

Electrical fans are used commonly to enhance personal comfort by the movement of air. Included among such fans are portable units that can be moved conveniently into different positions of desired use. Portable fans are available in a variety of forms including so-called floor fans that include often adjustable elongated stands and substantially shorter fans for placement on tables or the like. Also known are portable fans that can be converted in forms for either table or floor use. However, prior convertible fans have not provided fully satisfactory ease of conversion.

The object of this invention, therefore, is to provide an improved portable fan that can be easily converted into either a floor-type or table-type unit.

SUMMARY OF THE INVENTION

The invention is a portable electrical fan including a housing defining inlet and outlet openings for transmitting air; a fan blade disposed in the housing; a motor supported by the housing means and rotatably coupled to the fan blade; a base for placement on a support surface and having a coupling for detachable connection to the housing, the base defining a base receiving portion; an elongated standard having one end detachably secured to the coupling and an opposite end detachably secured to the housing, the standard defining a standard receiving portion; an electrical control connected to the motor; an enclosure retaining the electrical control and removably receivable by either the base receiving portion or the standard receiving portion; and a retainer for securing the enclosure to either the base receiving portion or the standard receiving portion. Conversion of the invention into either a floor or table fan is easily accomplished.

According to one feature of the invention, the base receiving portion and the standard receiving portion each include a locator mechanism for establishing a relative position between the enclosure and either the base or the standard. The locator mechanisms facilitate mounting of the enclosure on either the base to provide a table fan or the standard to provide a floor fan.

According to other features of the invention, the locator mechanisms are apertures, the enclosure defines a threaded hole, and the retainer is a set screw received by the threaded hole and one of the apertures. The desired conversion function is simplified by this structure.

According to still other features of the invention, the base includes an upright portion defining the coupling and the base receiving portion and the housing includes a connector portion adapted for detachable connection to either the coupling or the opposite end of the standard. The housing connector portion facilitates conversion operations and the base upright portion establishes a desirable table fan configuration.

According to yet other features of the invention, the upright portion, the standard, and the connector portion are each tubular; the one end of the standard is telescopically engageable with the upright portion; and the opposite end of the standard is telescopically engageable with the connector portion. These features simplify assembly of either the table or floor fan unit.

According to further features of the invention, the fan includes a base set screw and aligned threaded openings in the base upright and the one end of the standard, and a standard set screw and aligned threaded openings in the connector portion and the opposite end of the standard. These features further simplify conversion operations.

According to yet another feature of the invention, the enclosure defines a semi-cylindrical cavity for engaging either the standard or the upright portion. The enclosure cavity stably mounts to the tubular standard or base upright.

According to additional features of the invention, the base further includes an annular bottom portion for placement on a support surface, and an intermediate portion joining the bottom portion to the upright portion; and the upright portion is vertically aligned with a central position within the bottom portion. These features establish a desirable fan geometry.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
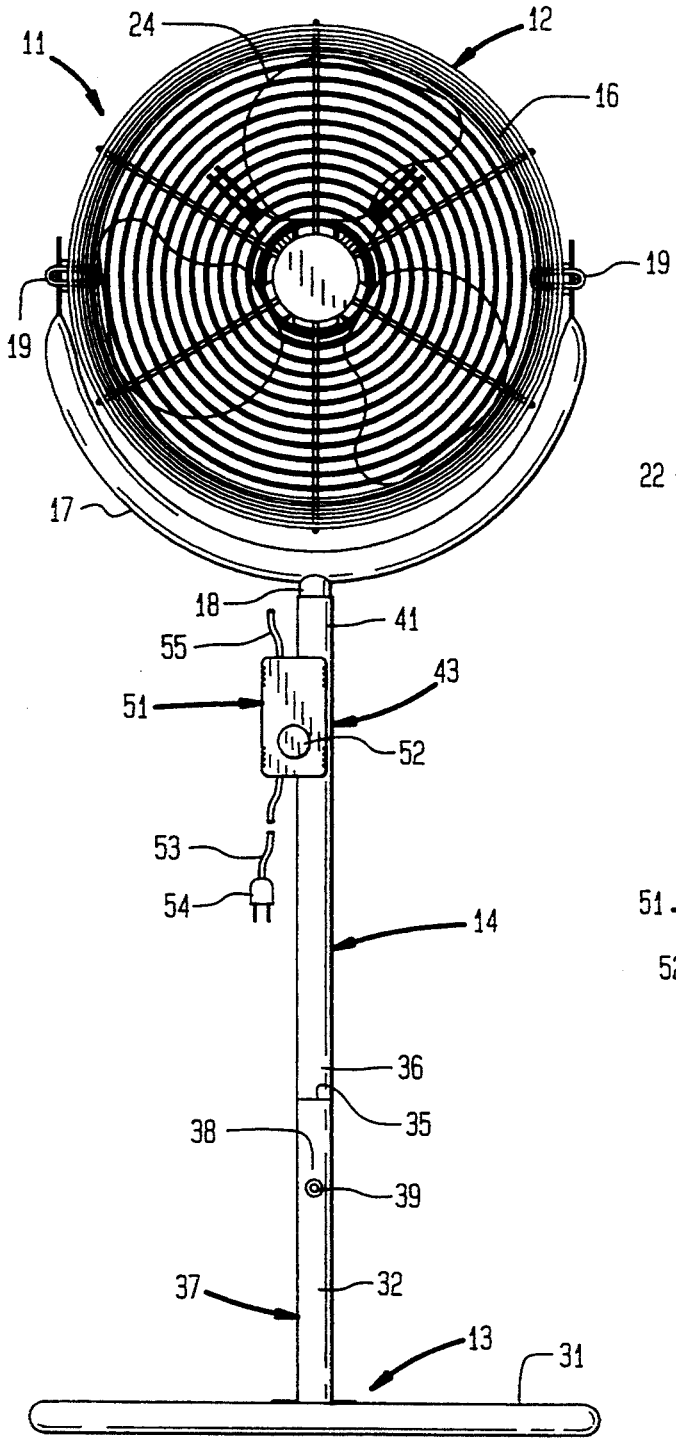
FIG. 1 is a front elevational view of a fan according to the invention.

A portable electrical fan 11 includes a housing 12 and a base 13 joined by an elongated standard member 14. The housing 12 includes a cage portion 16 and a tubular connector yoke portion 17 having a tubular connector stem portion 18 projecting from a mid-portion thereof. Opposite ends of the connector yoke portion 17 are fixed to opposite sides of the cage portion by threaded bolts 19. The cage portion 16 defines an inlet 21 for receiving air and an outlet 22 for discharging air. Retained within the cage portion 16 is a fan blade 24 rotatably coupled to a motor 25. In response to energization of the motor 25 the fan blade 24 is rotated to produce air flow between the inlet 21 and the outlet 22.

Figure 2:
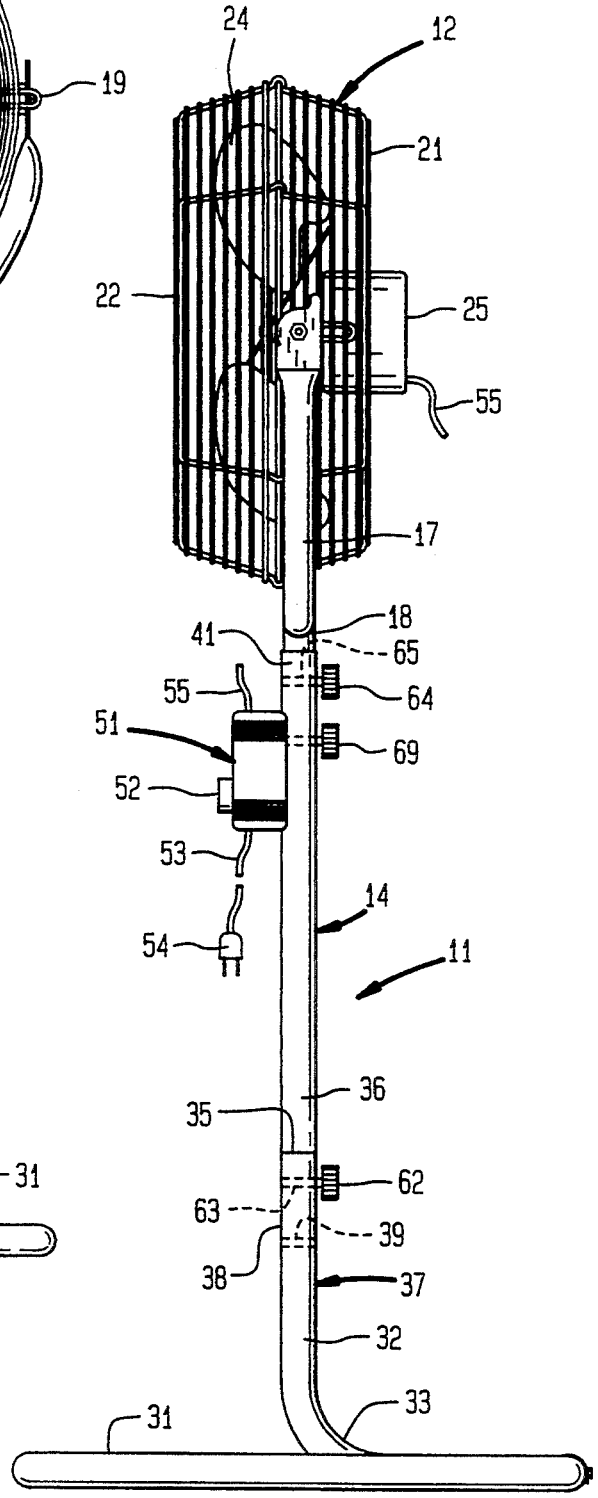
FIG. 2 is a side view of the fan shown in FIG. 1.
Figure 3:
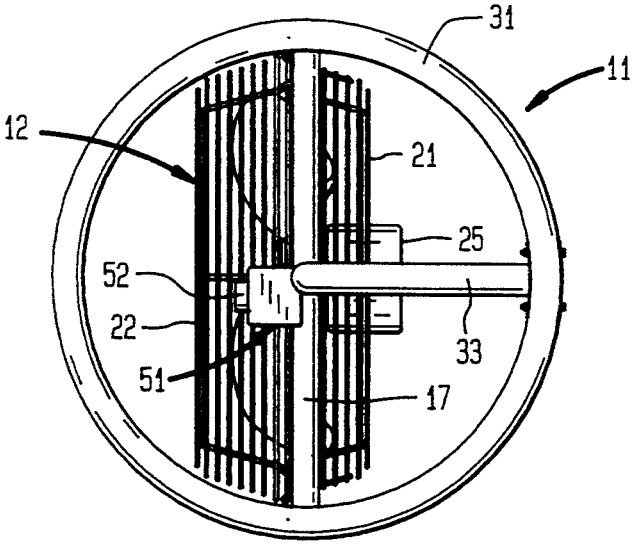
FIG. 3 is a bottom view of the fan shown in FIGS. 1 and 2.
Figure 7:
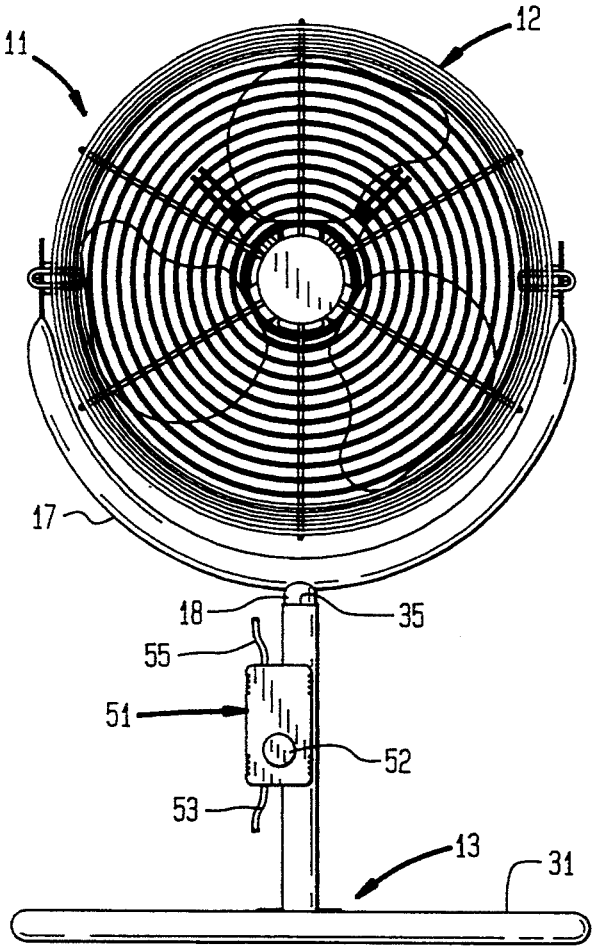
FIG. 7 is a front elevational view of a converted form of the fan shown in FIGS. 1–3.
Figure 8:
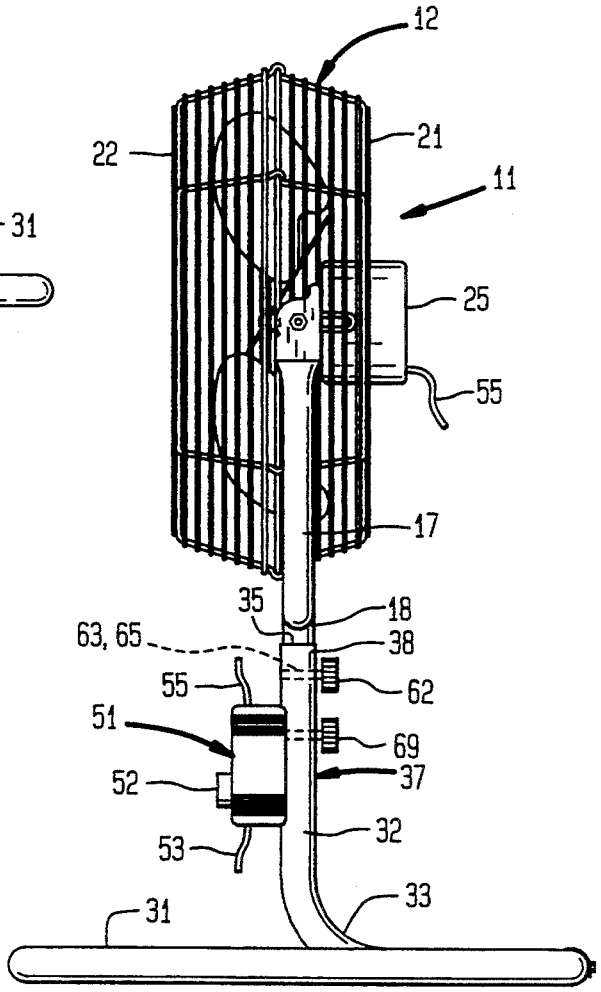
FIG. 8 is a side view of the converted fan shown in FIG. 7.

The base 13 is a hollow tubular member including an annular portion 31 for placement on a support surface, a vertical upright portion 32 and an intermediate portion 33 joined therebetween. As shown in FIGS. 2 and 3, the annular portion 31 is circular and the upright portion 32 is aligned with a position at the center thereof. The hollow cylindrical end 35 of the upright portion 32 forms a coupling for telescopically receiving either the standard member 14 as shown in FIGS. 1 and 2 or the connector stem portion 18 of the housing 12 as shown in FIGS. 7 and 8. Also defined by the upright portion 32 is a cylindrical receiving portion 38 and a threaded locator receiving aperture 39 therein.

The elongated standard 14 is a tubular member having one end 36 dimensioned to be telescopically received by the upright portion 32 and a hollow cylindrical opposite end 41 dimensioned to telescopically receive the connector stem portion 18 of the housing 12 as shown in FIGS. 1-3. Defined at an upper end of the standard 14 is a standard receiving portion 43 including a cylindrical standard receiving surface 44 (FIG. 4) and a standard locating, receiving aperture 45.

Figure 4:
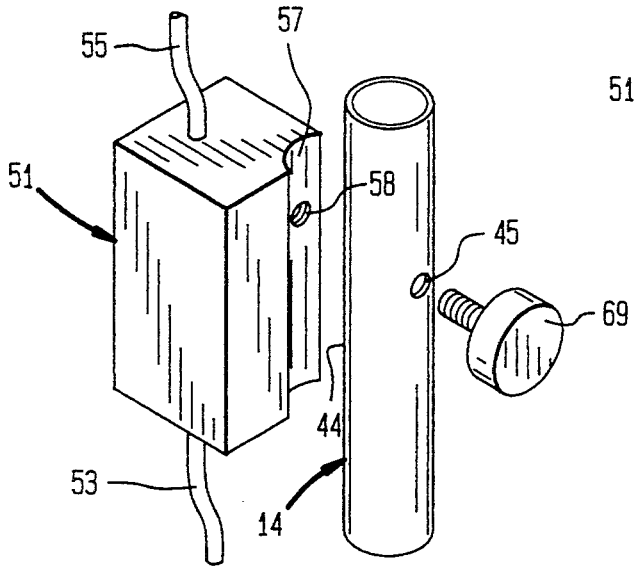
FIG. 4 is an exploded detailed view of an electrical control for the fan shown in FIGS. 1–3.

A control box enclosure 51 retains a conventional on-off switch (not shown) operated by a control knob 52. Connected to the switch (not shown) within the control box 51 is a power cord 53 having a plug 54 for connection to a conventional voltage outlet socket and a power cord 55 connected to the motor 25. A semi-cylindrical recess 57 is defined along the full length of the control box enclosure 51 as shown in FIG. 4. Formed in the recess 57 is a threaded locator hole 58.

Figure 5:
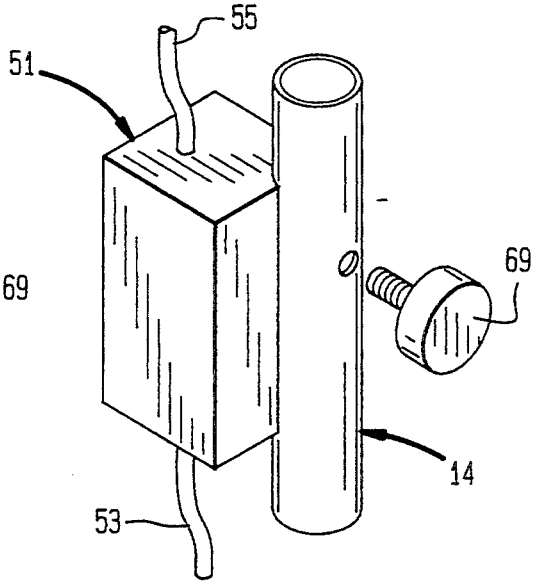
FIG. 5 is an assembled rear perspective view of the control shown in FIG. 4.
Figure 6:
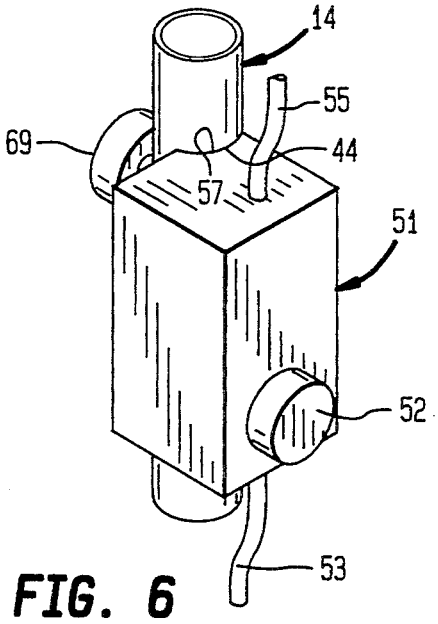
FIG. 6 is an assembled front perspective view of the control unit shown in FIG. 4.

When used as a floor fan, the device 11 is assembled as illustrated in FIGS. 1-3. First, the one end 36 of the standard 14 is inserted into the hollow cylindrical end 35 of the base upright portion 32 and secured therein by a base set screw 62 that is received by aligned threaded openings 63 in the standard 14 and upright portion 32. Next, the connector stem portion 18 of the housing 12 is inserted into the hollow cylindrical opposite end 41 of the standard 14 and secured therein by a standard set screw 64 that enters aligned threaded openings 65 in the standard 14 and stem 18. Finally, as shown in FIGS. 5 and 6, the control box enclosure 51 is mounted on the standard 14 with the cylindrical standard receiving surface 44 engaging the cylindrical recess 57 and the threaded locator hole 58 aligned with the receiving aperture 45 in the standard 14. The control box 51 is secured in that position by insertion of a retainer set screw 69 through the locator aperture 45 in the standard 14 for engagement with the threaded locator hole 58 in the control box 51. Upon insertion of the plug 54 into a conventional household outlet, the control knob 52 can be activated manually to energize the motor 25 and thereby produce rotation of the fan blade 24 and air flow between the inlet 21 and outlet 22.

When used as a table fan, the device 11 is assembled without the standard member 14 as illustrated in FIGS. 7 and 8. First, the stem 18 of the housing 12 is inserted into the hollow cylindrical coupling end 35 of the upright portion 32 and secured therein by insertion of the base set screw 62 into the aligned openings 63, 65, respectively, of the upright portion 32 and the stem portion 18. Next, the control box 51 is mounted on the upright portion 32 with the cylindrical base receiving surface portion 38 thereof engaged with the semi-cylindrical recess 57 and the threaded locator hole 58 aligned with the base receiving aperture 39. The control box 51 is secured in that position by insertion of the retainer set screw 69 through the receiving aperture 39 in the upright portion 32 for engagement with the threaded locator hole 58 in the control box 51. The plug 54 then can be inserted into a conventional outlet and the control knob 52 actuated to energize the motor 25 and produce air flow between the inlet 21 and the outlet 22 of the cage portion 16.

Obviously, many modifications and variations of the present invention are possible in light of the above teachings. It is to be understood, therefore, that the invention can be practiced otherwise than as specifically described.

What is claimed is:

1. A portable electrical fan comprising:

housing means defining inlet and outlet openings for transmitting air;

a fan blade disposed in said housing means;

a motor supported by said housing means and rotatably coupled to said fan blade;

base means for placement on a support surface and having coupling means adapted for detachable connection to said housing means, said base means defining base receiving means and base locator means;

an elongated standard having one end detachably secured to said coupling means and an opposite end detachably secured to said housing means, said standard defining standard receiving means and standard locator means;

electrical control means connected to said motor;

an enclosure retaining said electrical control means and adapted to be removably received by either said base receiving means or said standard receiving means in relative positions determined by, respectively, said base locator means and said standard locator means; and retainer means for securing said enclosure to either said base receiving means or said standard receiving means.

2. A portable electrical fan according to claim 1 wherein each said locator means is an aperture.

3. A portable electrical fan according to claim 2 wherein said enclosure defines a threaded hole, and said retaining means is a retainer set screw received by said threaded hole and one of said apertures.

4. A portable electrical fan according to claim 3 wherein said base means comprises an upright portion defining said coupling means and said base receiving means.

5. A portable electrical fan according to claim 4 wherein said housing means comprises a connector portion adapted for detachable connection to either said coupling means or said opposite end of said standard.

6. A portable electrical fan according to claim 5 wherein said upright portion, said standard, and said connector portion are each tubular; said one end of said standard is telescopically engageable with said upright portion; said connector portion is telescopically engageable with said upright portion and said opposite end of said standard is telescopically engageable with said connector portion.

7. A portable electrical fan according to claim 6 including base securing means for securing said upright portion to said standard, and standard securing means for securing said connector portion to said standard.

8. A portable electrical fan according to claim 7 wherein said base securing means comprises a base set screw and aligned threaded openings in said base upright and said one end of said standard, and said standard securing means comprises a standard set screw and aligned threaded openings in said connector portion and said opposite end of said standard.

9. A portable electrical fan according to claim 6 wherein said enclosure defines a semi-cylindrical cavity for engaging either said standard or said upright portion.

10. A portable electrical fan according to claim 9 including base securing means for securing said upright portion to said standard, and standard securing means for securing said connector portion to said standard.

11. A portable electrical fan according to claim 10 wherein said base securing means comprises a base set screw and aligned threaded openings in said base upright and said one end of said standard, and said standard securing means comprises a standard set screw and aligned threaded openings in said connector portion and said opposite end of said standard.

12. A portable electrical fan according to claim 4 wherein said base means further comprises an annular bottom portion for placement on a support surface, and an intermediate portion joining said bottom portion to said upright portion; and said upright portion is vertically aligned with a central position within said bottom portion.

13. A portable electrical fan according to claim 12 wherein said housing means comprises a connector portion adapted for detachable connection to either said coupling means or said opposite end of said standard.

14. A portable electrical fan according to claim 13 wherein each said upright portion, said standard, and said connector portion is tubular; said one end of said standard is telescopically engageable with said upright portion; said connector portion is telescopically engageable with said upright portion and said opposite end of said standard is telescopically engageable with said connector portion.

15. A portable electrical fan according to claim 14 including base securing means for securing said upright portion to said standard, and standard securing means for securing said connector portion to said standard.

16. A portable electrical fan according to claim 15 wherein said base securing means comprises a base set screw and aligned threaded openings in said base upright and said one end of said standard, and said standard securing means comprises a standard set screw and aligned threaded openings in said connector portion and said opposite end of said standard.

17. A portable electrical fan according to claim 14 wherein said enclosure defines a semi-cylindrical cavity for engaging either said standard or said upright portion.

18. A portable electrical fan according to claim 17 including base securing means for securing said upright portion to said standard, and standard securing means for securing said connector portion to said standard.

19. A portable electrical fan according to claim 18 wherein said base securing means comprises a base set screw and aligned threaded openings in said base upright and said one end of said standard, and said standard securing means comprises a standard set screw and aligned threaded openings in said connector portion and said opposite end of said standard.

* * * * *